United States Patent [19]

Kroll

[11] 4,385,621

[45] May 31, 1983

[54] OIL STOVE FOR BURNING WASTE OIL AND NORMAL HEATING OIL

[76] Inventor: Walter Kroll, 42 Burgstaller Strasse, 7141 Kirchberg, Murr, Fed. Rep. of Germany

[21] Appl. No.: 301,021

[22] Filed: Sep. 10, 1981

Related U.S. Application Data

[62] Division of Ser. No. 54,954, Jul. 5, 1979, Pat. No. 4,308,854.

[30] Foreign Application Priority Data

Jul. 24, 1978 [DE] Fed. Rep. of Germany ..... 2832389

[51] Int. Cl.[3] ..... F24C 5/00

[52] U.S. Cl. ..... 126/93; 126/94; 126/58

[58] Field of Search ..... 126/93, 94, 58, 84; 210/172, 163, 174; 137/313, 140, 314, 546, 547, 549; 4/291, 293, 288, 652, 653

[56] References Cited

U.S. PATENT DOCUMENTS

| | | | |
|---|---|---|---|
| 1,548,400 | 8/1925 | Walker | 210/172 |
| 2,219,532 | 10/1940 | Roads | 126/93 |
| 2,222,202 | 11/1940 | Levine | 126/93 |
| 2,519,241 | 8/1950 | Findley | 126/93 X |
| 2,570,049 | 10/1951 | Densel | 126/94 |
| 2,656,884 | 10/1953 | Russel | 126/93 |
| 2,804,066 | 8/1957 | McCutchen | 126/93 X |
| 3,029,803 | 4/1962 | Breese | 126/94 X |

*Primary Examiner*—Larry Jones

[57] ABSTRACT

An oil stove for burning both waste oil and heating oil has a primary combustion chamber for the initial combustion of fuel and an adjoining secondary combustion chamber of larger diameter in which combustion is completed. The two chambers are located in a housing and a fan is arranged at the bottom of the housing for delivering air to the inside of the housing. The air is warmed by its passage between the walls of the housing and the primary and secondary combustion chambers and is discharged for heating purposes via louvres at the top of the housing.

The primary combustion chamber is defined by a pot having air inlet openings in its sidewall, a substantially closed base, a burner ring located towards the upper end of the pot and a closed jacket surrounding the pot spaced from said sidewall. In operation a pool of fuel is formed at the base of the pot and a part of the fan delivery is ducted to the space between the closed jacket and the pot for supplying air for the combustion process.

Dual fuel operation is enabled by the intentional forced cooling of the base plate defining the closed base of the primary combustion chamber and accumulated sediment from the burning of waste oil can be cleaned from the base plate via an access tunnel leading into the primary combustion chamber.

8 Claims, 3 Drawing Figures

OIL STOVE FOR BURNING WASTE OIL AND NORMAL HEATING OIL

Figure 1:
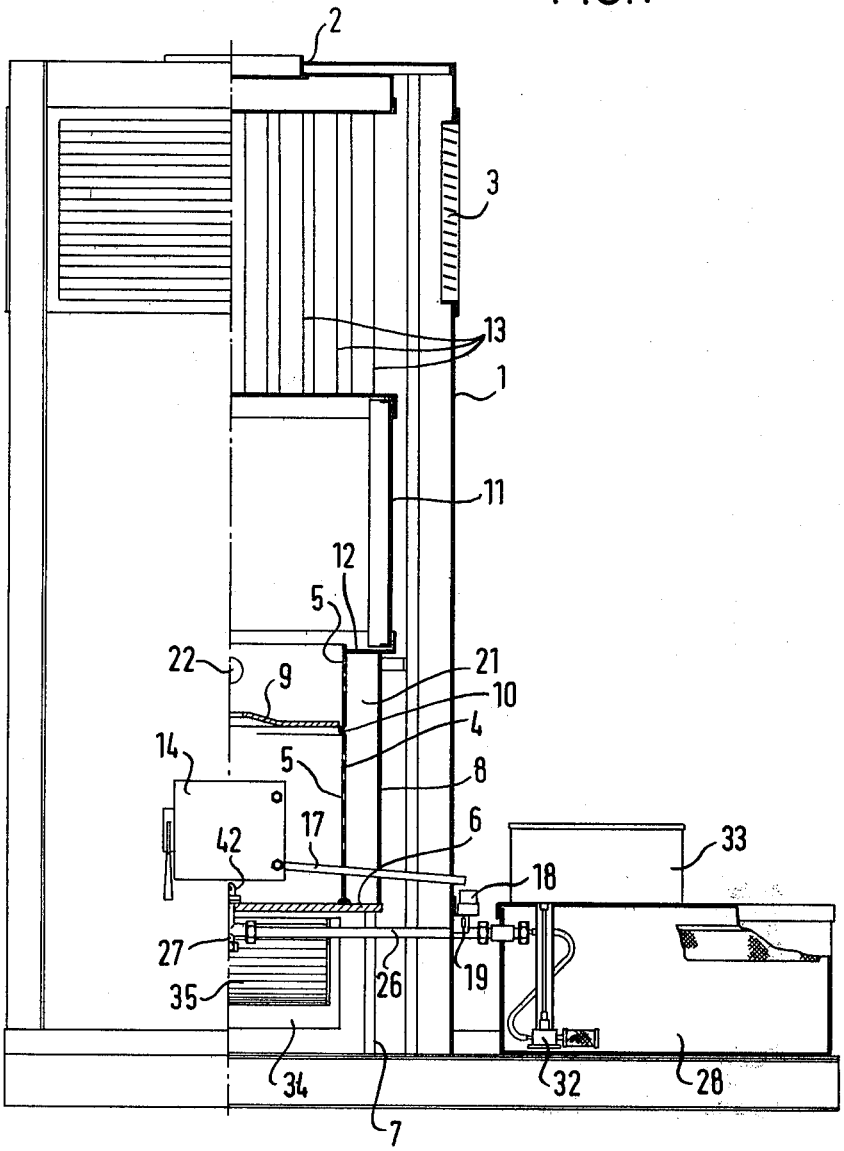

This is a division of application Ser. No. 054,954, filed July 5, 1979, now U.S. Pat. No. 4,308,854.

The invention relates to an oil stove and has particular reference to an oil stove for burning both waste oil and heating oil.

Stoves for burning waste oil are known which comprise primary and secondary combustion chambers with the primary combustion chamber defined by a pot with air inlets defined in its side wall, a base plate, a burner ring located within the pot and with the pot itself being located within a jacket defined by an external housing. Oil is supplied to the pot via an oil supply line from a supply tank.

Oil stoves of this kind are generally known and are utilised in particular in work shops and factories where considerable quantities of old oil is available for example the waste oil drained from motor car sumps. In this manner it is possible to heat the building extremely economically and simultaneously to solve the problem of disposing of waste oil in a manner which, with properly controlled combustion, is environmentally sound and acceptable.

There are however a number of work shops and factories where waste oil occurs but where the quantities available are not sufficient in order to continuously operate a stove for burning waste oil as is particularly necessary during the cold periods of the year. In these cases the introduction of customary oil stoves for burning waste oil generally founders as these known types of oil stove must be exclusively operated with waste oil and it is not possible to operate them with the lighter fractions of normal heating oil.

If these known waste oil stoves are operated with normal heating oil, then pronounced soot formation regularly occurs and in addition there are difficulties in achieving the required degree of control over waste oil stoves operated with normal heating oil.

A principal object of the invention is thus to provide an oil stove which is so arranged that it can be operated both with waste oil and also with normal heating oil which ensure the necessary degree of operational reliability during both kinds of operation, namely the operation with waste oil and with normal heating oil, and which enables the full range of control to be maintained with either type of oil.

In accordance with the invention this object is solved by an oil stove comprising a first primary combustion chamber defined by a pot having air inlet openings in its side wall a substantially closed base, a burner ring, means locating the burner ring towards the upper end of said pot and the pot being surrounded by a closed jacket spaced from said side wall, there being further provided a secondary combustion chamber adjoining and of larger diameter than the pot, an oil supply tank, an oil line leading from this oil supply tank into the pot and a fan and duct means for blowing a stream of air across the underside of said substantially closed base.

In surprising manner the provision of the fan and duct means makes it posible to operate the oil stove both with waste oil and also with normal heating oil so that it can be economically introduced in situations where only a limited quantitiy of waste oil is available. This arises because the transition from operation with waste oil to operation with normal heating oil and vice versa is possible without difficulties and thus the required constant operation can be maintained.

The fan used in accordance with the invention fulfils a multiple function and indeed in particular the function of producing an air circulation which favourably effects the heat exchange and the function of cooling the base plate of the pot of the primary combustion chamber.

Decisive significance is attributed to the cooling of the base plate of the combustion chamber in satisfying the above-mentioned principal object of the invention.

It has hitherto been the practice in known solutions to specifically avoid cooling the base plate.

As it was to be expected that cooling of the base plate would lead to a deterioration of the operation, in particular during the combustion of waste oil, it is assumed that the surprising effect of the invention is brought about by the fact that an insulating layer caused by the accumulation of sediment is formed between the flame layer and the base plate during operation with waste oil and thus that the cooling effect does not produce any undesired results. On the other hand during operation of the stove with normal heating oil the cooling of the base plate is responsible for making possible a combustion process which in practice avoids soot formation and enables a fully controllable combustion process.

An especially advantageous embodiment of an oil stove in accordance with the invention is characterized by the definition, between the closed jacket and the pot, of an annular chamber which extends substantially over the height of the pot and which is connected via at least one duct to the outlet of the fan for the purpose of supplying air for the combustion process. The complete separation of the air stream for heat exchange and for cooling the base plate from the supply of combustion air to the pot of the primary combustion chamber, which is achieved in a practical manner by the above embodiment, has favourable effects on the overall function and efficiency of the stove. This is a consequence of the fact that the respective different requirements of heat exchange and supply of air for the combustion process can respectively and separately be controlled to achieve an optimum result.

The primary and secondary combustion chambers are preferably located within an external housing to which the fan is fastened with the outlet from the fan disposed beneath the base plate so that the cooling air stream can cool the base plate of the pot in the desired manner, either directly or by the provision of suitable deflection devices.

As the air which subsequently cools the base plate then flows upwardly through the space defined between the housing and the closed jacket and secondary combustion chamber it is presented with adequate opportunity to pick up heat from the hot components prior to it discharge through louvres at the top of the housing.

The supply of oil to the pot of the primary combustion chamber preferably takes place from below via a central opening in the substantially closed base plate of the combustion chamber. A suitable connection piece connected via a substantially horizontal tube to the oil supply tank preferably opens into this oil supply opening.

A sediment deflector is provided which comprises a plate covering the oil supply opening and spaced from the base plate. The sediment deflector is significant and advantageous for the operation of the oil stove and is preferably held in position by means of a pin or securing bolt located within the oil supply opening and is preferably spaced above the base plate by means of lugs defined by turned down marginal regions of the sediment deflecting plate. The pin must naturally have a significantly smaller diameter than the oil supply opening in order to avoid interfering with the supply of oil.

A cleaning access door is usefully provided in the wall of the housing surrounding the primary and secondary combustion chambers and communicates with the primary combustion space inside the burner pot via a tunnel with a slanting base. In this way access is available through the tunnel for scraping sediment from the base of the oven prior to operation with normal heating oil. In similar fashion the access door enables the sediment deflecting plate to be lifted out of the oil supply opening for cleaning purposes.

Figure 2:
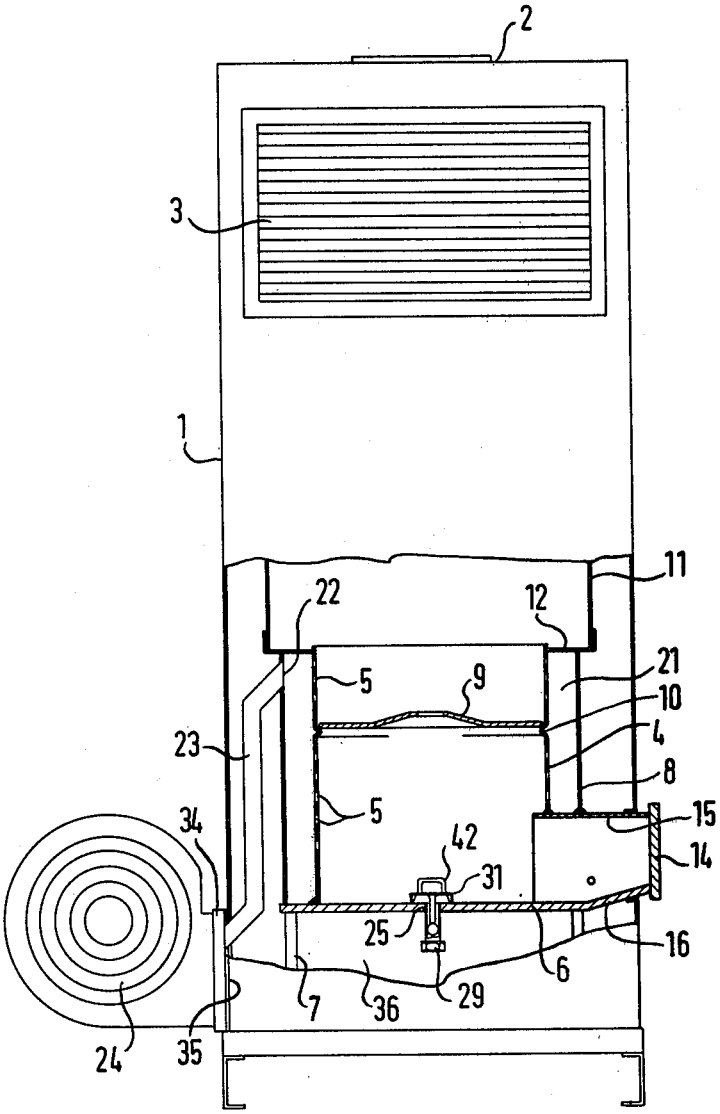
Figure 3:
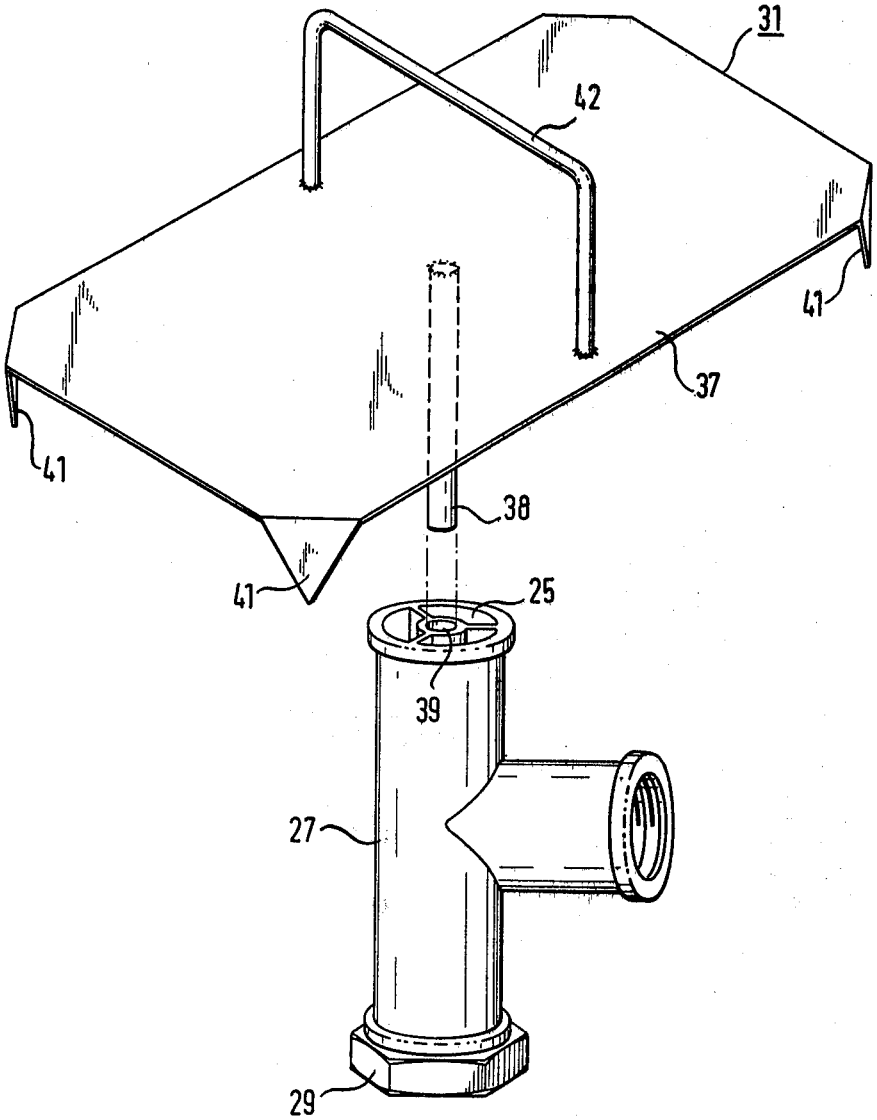

The invention will now be further described by way of example only and with reference to the accompanying drawings which show:

FIG. 1 a schematic partial longitudinal section of an oil stove and associated oil supply tank, FIG. 2 a likewise partially sectioned rear view of the oil stove of FIG. 1 illustrating the access tunnel and, FIG. 3 a perspective view of the sediment deflector plate and the means for locating it within the stove.

Referring firstly to FIGS. 1 and 2 there can be seen an oil stove suitable for burning both waste oil and normal domestic heating oil.

The stove basically comprises an outer housing 1 which is closed at its base and which is provided with a heat exchanger cover 2 at its upper end which is supported on tubular supports from the base of the housing. Louvre deflectors 3 are provided in the upper region of the housing 1 in the sidewalls thereof.

Inside the housing 1 there is located a primary combustion chamber defined by a pot 4 having air inlet openings 5 in its sidewall, a substantially closed base 6 which is likewise supported from the base of the housing on support tubes 7, and a closed jacket 8 which is spaced from the side wall of the pot 4. The primary combustion chamber also includes a customary burner ring 9 which is removable and which sits on an annular indentation 10 in the wall of the pot 4. The base plate 6 and the walls of the primary combustion chamber are preferably made of steel and are joined together by welding.

Above the pot 4 there is located a secondary combustion chamber 11 which is preferably of larger diameter than the pot 4. The secondary combustion chamber is joined by sheet metal parts 12 to the primary combustion chamber 5 and is vented at its upper end via a series of heat exchange tubes 13 through a chimney which is not shown. The interior of the primary and secondary combustion chambers is thus sealed from the space between the wall of the housing 1 and the outside of the chambers.

An access door 14 is provided in the wall of the housing 1 and communicates via an enclosed tunnel 15 with the inside of the pot 4 for cleaning purposes. The base 16 of the cleaning access tunnel 15 is usefully a continuation of the base plate 6 of the primary combustion chamber and is inclined thereto so as to prevent the film of oil within the combustion chamber from escaping via the access door. The angled floor also enables sediment collecting at the base of the primary combustion chamber on the base plate to be swept out of the access door. This is necessary after a period of time because of the accumulated sediment from operation with waste oil.

In order to ensure safe operation on the occurrence of disturbances an overflow tube 17 is provided in the customary manner which opens outside of the stove above a beaker 18 with which there is associated a micro switch 19 which automatically shuts down the oil stove when it is actuated by the weight of a predetermined quantity of oil in the beaker 18.

Air is supplied to the air inlet openings 5, which are preferably distributed in a series of rings around the periphery of the side wall of the combustion pot 4, via the annular chamber 21 which is defined between the jacket 8 and the pot 4. The jacket 8 is in fact a section of tube which extends from the outer periphery of the base plate 6 to a transverse wall 12 provided between the primary and secondary combustion chambers. The annular chamber 21 is supplied with air via an air supply opening 22 in the jacket 8 at the upper end of the pot 4. Air is introduced for combustion through this air supply opening in controlled manner via a duct 23 from a fan 24. Air passes into the pot 4 via the inlet openings 5.

The supply of oil to the pot 4 or to the base plate of the pot 4 takes place via a central opening 25 in the base plate and indeed from below via a generally horizontally disposed line 26 and an intermediate T-piece 27 from a supply tank 28. This T-shaped intermediate piece (FIG. 3) is particularly chosen because the downwardly directed free connection can be provided with a removable closure cap 29 which makes it possible to eventually tap off any water collecting in the chamber.

A sediment deflector 31 which will be more precisely described later with reference to FIG. 3 is located above the oil inlet opening 25 and prevents sediment from blocking this supply tube.

The fan 24 has other functions in addition to supplying the air for the combustion process via the duct 23. A part of the discharge from the fan 24 is namely used for improving the heat exchange within the stove and for cooling the base plate 6 of the primary combustion chamber. The capacity of the fan is chosen so that it can maintain a pressure within the range 10 to 20 and preferably of 15 millimeters of water beneath the base plate 6 inside the housing 1. The position in which the fan 24 is fastened to the wall of the housing 1 and the duct defined by the base of the housing and the base plate of the primary combustion chamber serves to ensure a strong flow of cooling air across the base plate 6. After extracting heat from the base plate the air then rises and extracts further heat from the jacket 8 and the outer wall of the secondary combustion chamber 11 before being discharged for heating purposes via the louvres 3. The space adjacent the louvres is filled by the vertical tubes 13 which carry the exhaust gases away from the secondary combustion chamber 11 and the outer walls of these tubes greatly increase the heat transfer to the rising air from the fan.

The supply of oil takes place by way of a gear pump 32 which is arranged in the base region of the supply tank 28 and is driven by means of a motor which is housed in a control unit 33 which is able, in known manner, to control the speed of the motor and thus the volume of fuel delivered to the primary combustion chamber via the positive displacement gear pump.

The supply tank illustrated in the drawing is especially constructed for receiving waste oil. By means of a switch over valve which is not shown in the drawing the oil supply line 18 can also be connected with a storage tank for normal heating oil so that the stove can be simply switched over from heating oil to waste oil and vice versa. For the switch over from waste oil to normal heating oil it is naturally necessary to firstly clean sedimentary deposits from the base plate.

The arrangement of the fan 24 at the rear side of the oil stove is illustrated in detail in FIG. 2. The fan is preferably connected via a flange 34 to the housing 1 and its principle outlet opening 35 opens beneath the base plate 6 in the pressurized space 36. The air duct 23 which leads to the annular chamber 21 and which supplies the annular chamber with the necessary combustion air also receives its supply from the outlet of the fan 25.

The air flow which occurs in the pressurized space 36 is responsible for supplying the required cooling of the base plate which is a prerequisite for operating the oil stove both with waste oil and with normal heating oil.

The sediment deflector 31 which can be seen from FIGS. 1 and 2 and which is shown in more detail in FIG. 3 basically comprises a plate 37 which is centrally located by means of a pin 38 in a guide member 39 formed in the T-piece 17 of the oil supply line. The height of the sediment deflector plate above the base plate 6 is determined by lugs 41 formed by turned down marginal parts of the plate. The marginal parts are conveniently the corners of the plate. The pin 38 must naturally be of a significantly smaller diameter than that of the oil inlet opening in order to avoid disturbing the flow therethrough. The centrally located aperture for the pin 38 ensures that the sediment deflector is centrally arranged relative to the oil inlet opening. The sediment deflecting plate is conveniently provided with a hand grip defined by the loop 42 which enables the sediment deflector to be removed for cleaning via the cleaning access door 14. The central position of the sediment deflector plate avoids any danger of the oil supply becoming blocked.

The described oil stove is particularly characterized by the multiple function of the fan that is used and also by its high operating efficiency both when operating with waste oil and with normal heating oil and above all ensures safe and environmentally sound operation for both operating modes.

To control the heat output of the stove it is only necessary to rotate a single knob on the control device. Rotation of this knob varies both the speed of the motor driving the positive displacement metering pump and the speed of the fan thus varying the amount of fuel available for burning and the supply of air for combustion and cooling purposes. The motor speed control can be of any known kind. It is particularly advantageous that the described cooling of the base plate enables the above described control to be used for operation with both fuels so that the full range of control is available in each case.

During the changeover from one fuel to the other it is not necessary to switch off the stove; it is merely advantageous, when converting from operation with waste oil to operation with domestic heating oil, for the stove to be operated at a low setting for a short period when the accumulated sediment can be removed as previously described.

I claim:

1. An oil stove for burning oils and in particular waste oil, the stove comprising: an external housing, a first primary combustion chamber defined by a pot having a side wall and air inlet openings in said side wall, a substantially closed base, a burner ring, means locating the burner ring towards the upper end of said pot, said pot being surrounded by a closed jacket spaced from said side wall to define a space therebetween, a secondary combustion chamber adjoining and of larger diameter than said pot, said primary and secondary combustion chamber being located in said housing, a fan, duct means for supplying air from said fan to said space, an oil supply tank, a substantially centrally disposed oil supply line leading from said oil supply tank to said oil supply opening via a positive displacement metering pump, and a sediment deflector located within said pot spaced apart from said base and above said oil supply opening, a cleaning access door provided within said housing substantially adjacent said substantially closed base, there being a tunnel communicating between said cleaning access door and and the interior of said pot, the base of the tunnel being inclined with a relatively shallow angle to said substantially closed base whereby sediment collecting in said pot can be removed therefrom.

2. An oil stove in accordance with claim 1 and wherein said deflector has a locating pin and said oil supply opening includes means for holding said locating pin so that said sediment deflector is removably located by said pin in the oil supply opening.

3. An oil stove according to claim 2 and wherein said sediment deflector comprises a plate.

4. An oil stove according to claim 3 and wherein said plate is spaced from said substantially closed base by lugs.

5. An oil stove according to claim 3 and wherein said lugs comprise downwardly turned marginal portions of said plate.

6. An oil stove according to claim 1 and wherein said sediment deflector is provided with a lifting hoop.

7. An oil stove in accordance with claim 1 and wherein said oil line is connected to said oil supply opening via a T: shaped connection piece having a drain plug at its lower-most end.

8. An oil stove for burning oils, and in particular waste oil, the stove comprising an external housing, a first primary combustion chamber defined by a pot having a side wall and air inlet openings in said side wall, a substantially closed base, a burner ring, means locating the burner ring towards the upper end of said pot, said pot being surrounded by a closed jacket spaced from said side wall to define a space therebetween, a secondary combustion chamber adjoining and of larger diameter than said pot, a fan, duct means for supplying air from said fan to said space, an oil supply tank, a substantially centrally disposed oil supply opening in said substantially closed base, an oil supply line leading from said oil supply tank to said oil supply opening via a positive displacement metering pump, and a control for varying the output of said stove and comprising means for simultaneously varying both the speed of said positive displacement pump and the speed of said fan, said primary and secondary combustion chambers being located within said housing and said second duct means being arranged to blow a stream of cold air from said fan across the underside of said substantially closed base to cool the same irrespective of the viscosity of the oil being burned, there being wall means of said housing defining a flow passage for subsequently guiding said stream of cold air past said closed jacket and said secondary combustion chamber, whereby to warm said air for heating purposes without said air coming into contact with gases formed by combustion of said oil.

* * * * *